US008800077B2

(12) United States Patent
Colombo

(10) Patent No.: US 8,800,077 B2
(45) Date of Patent: Aug. 12, 2014

(54) PULL DOWN BED WITH AUTOMATIC LOCKING DEVICE

(75) Inventor: Luigi Colombo, Milan (IT)

(73) Assignee: Clei S.R.L., Carugo (IT)

( * ) Notice: Subject to any disclaimer, the term of this patent is extended or adjusted under 35 U.S.C. 154(b) by 360 days.

(21) Appl. No.: 13/264,677

(22) PCT Filed: Apr. 21, 2010

(86) PCT No.: PCT/EP2010/002422

§ 371 (c)(1),
(2), (4) Date: Oct. 14, 2011

(87) PCT Pub. No.: WO2010/121788

PCT Pub. Date: Oct. 28, 2010

(65) Prior Publication Data

US 2012/0060279 A1 Mar. 15, 2012

(30) Foreign Application Priority Data

Apr. 21, 2009 (IT) ..... MI2009A0656

(51) Int. Cl.
*A47C 17/56* (2006.01)

(52) U.S. Cl.
USPC ..... 5/159.1; 5/164.1; 5/136; 5/162; 5/139; 5/140; 5/160

(58) Field of Classification Search
USPC ..... 5/159.1, 164.1, 136, 162, 139, 140, 5/160; 108/48, 37
See application file for complete search history.

(56) References Cited

U.S. PATENT DOCUMENTS

| | | | | | |
|---|---|---|---|---|---|
| 640,965 | A * | 1/1900 | Songer | 5/166.1 |
| 1,236,515 | A * | 8/1917 | Welch | 5/172 |
| 1,262,371 | A * | 4/1918 | Meyers | 5/172 |
| 3,097,369 | A * | 7/1963 | Emch | 5/136 |
| 5,033,134 | A * | 7/1991 | Burchett | 5/133 |
| 5,353,452 | A * | 10/1994 | Rulis | 5/136 |
| 5,978,988 | A * | 11/1999 | Burchett | 5/136 |
| 6,105,185 | A * | 8/2000 | DiRocco | 5/164.1 |
| 6,779,208 | B2 * | 8/2004 | Lim et al. | 5/136 |
| 7,823,231 | B2 * | 11/2010 | Paoutoff | 5/136 |
| 2008/0052824 | A1 * | 3/2008 | Stoltzfus | 5/136 |
| 2010/0043142 | A1 * | 2/2010 | Whitford | 5/136 |

FOREIGN PATENT DOCUMENTS

| | | | |
|---|---|---|---|
| AT | 301 090 | B | 8/1972 |
| DE | 298 00 911 | U1 | 4/1998 |
| DE | 199 50 815 | A1 | 6/2000 |
| DE | 20 2004 000698 | U1 | 5/2004 |

* cited by examiner

*Primary Examiner* — William Kelleher
(74) *Attorney, Agent, or Firm* — R. Neil Sudol; Henry D. Coleman

(57) ABSTRACT

A pull down bed with automatic locking device has a movable framework, which constitutes a mattress frame, and is hinged to a container body, which constitutes a piece of furniture, so as to define a closed position, in which said mattress frame is substantially inside the piece of furniture, and an open position, for use as a bed, in which the mattress frame is in a horizontal position and rests on the ground by means of two feet. The mattress frame is hinged to the piece of furniture at one end and has its feet at the other end. The pull down bed includes a device for locking said mattress frame in the closed or horizontal position, which is actuated by an actuation device, which includes the feet.

12 Claims, 9 Drawing Sheets

PULL DOWN BED WITH AUTOMATIC LOCKING DEVICE

BACKGROUND OF THE INVENTION

The present invention relates to a pull down bed with automatic locking device.

A pull down bed, or "Murphy" bed, is a piece of furniture containing a tilting framework, which constitutes the mattress frame.

The mattress frame is generally constituted by a structure made of welded steel tubes, which includes rotation pivots provided with springs which can be adjusted as a function of the load.

The mattress frame generally has two feet, which can retract when the frame is pulled up, and brackets for fastening a wood closure panel.

The mattress frame also has a mattress holder and normally a spring system made of laminated wood slats inserted in receptacles of the longitudinal members of the mattress frame.

Murphy beds have been commercially available since the early 1900s and numerous and disparate structures with constructive and functional improvements have been proposed.

An important requirement of a pull down bed is that it is constructively strong and reliable and its locking must be ensured both in the horizontal position, for use as a bed, and when it is closed in the vertical position.

Another important requirement of a pull down bed is to ensure a simple and easy actuation, which does not require excessive efforts of the user.

Another fundamental feature of a pull down bed is that it should occupy as little space as possible because it is generally used where the space available is limited.

It is difficult to provide a structure which is at the same time compact, easy to operate, strong and reliable.

Commercially available pull down beds in fact do not simultaneously and fully provide all the requirements listed above.

OBJECTS OF THE INVENTION

The aim of the present invention is to provide a pull down bed with automatic locking device that is improved with respect to conventional pull down beds in every constructive and functional aspect.

An object of the invention is to provide a pull down bed that has a system for automatic locking in both vertical and horizontal positions that is safe and reliable.

A further object of the invention is to provide a pull down bed that can be released from one position and moved into the other position simply and easily.

A further object is to provide a pull down bed that is aesthetically pleasant and compact.

A further object of the present invention is to provide a pull down bed which, by virtue of its particular constructive characteristics, is capable of giving the greatest assurances of reliability and safety in use.

A further object of the present invention is to provide a pull down bed that can be manufactured easily by using commonly commercially available elements and materials and is also competitive from an economic standpoint.

SUMMARY OF THE INVENTION

This aim and these objects, as well as others which will become better apparent hereinafter, are achieved by a pull down bed, with automatic locking device, comprising a movable framework, which constitutes a mattress frame, and is hinged to a container body, which constitutes a piece of furniture, so as to define a closed position, in which said mattress frame is substantially inside said piece of furniture, and an open position, for use as a bed, in which said mattress frame is in a horizontal position and rests on the ground by means of feet; said mattress frame is hinged to said piece of furniture at one end and has said feet at the other end; said structure is characterized in that it comprises a device for locking said mattress frame in said closed and horizontal position, said locking device is actuated by an actuation device, said actuation device comprises said feet.

BRIEF DESCRIPTION OF THE DRAWINGS

Further characteristics and advantages will become better apparent from the description of preferred but not exclusive embodiments of the invention, illustrated by way of non-limiting example in the accompanying drawings, wherein.

DETAILED DESCRIPTION

Figure 1:
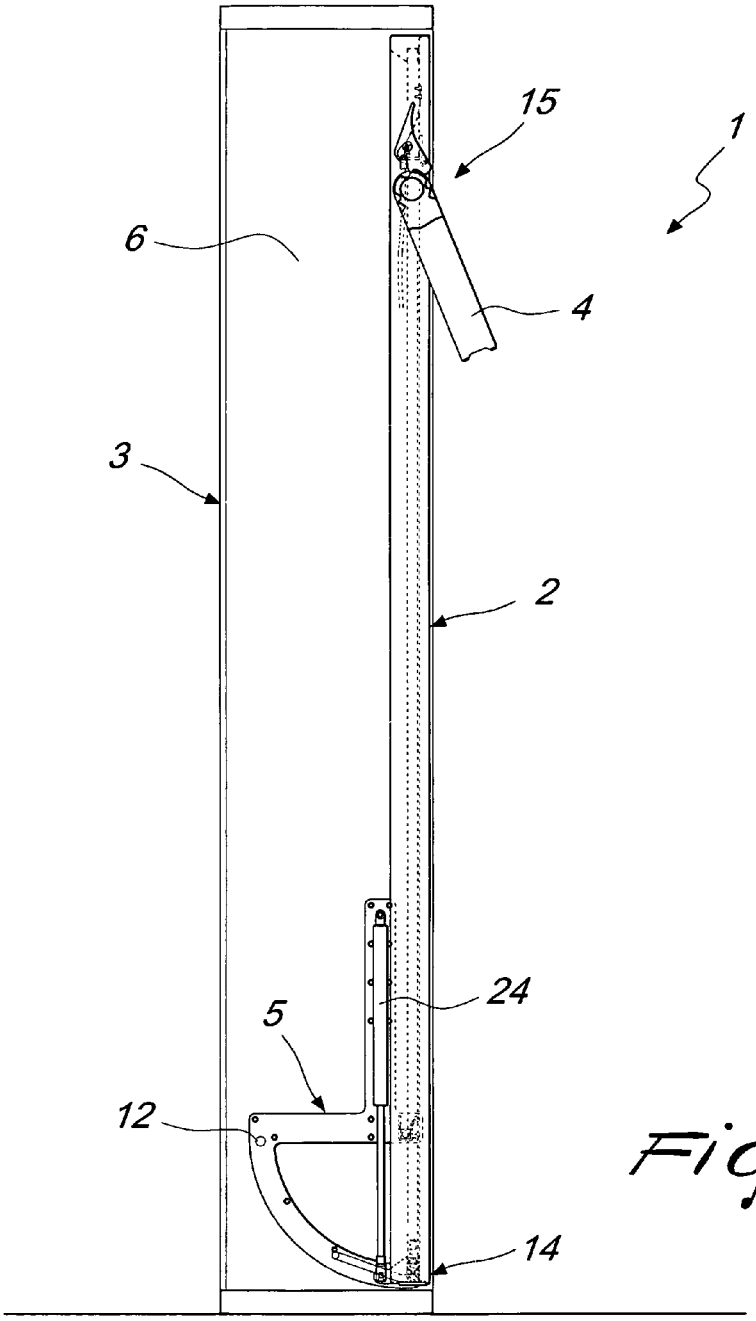
FIG. 1 is a side view of a pull down bed according to the present invention, illustrated in the closed position at the beginning of the opening action.
Figure 3:
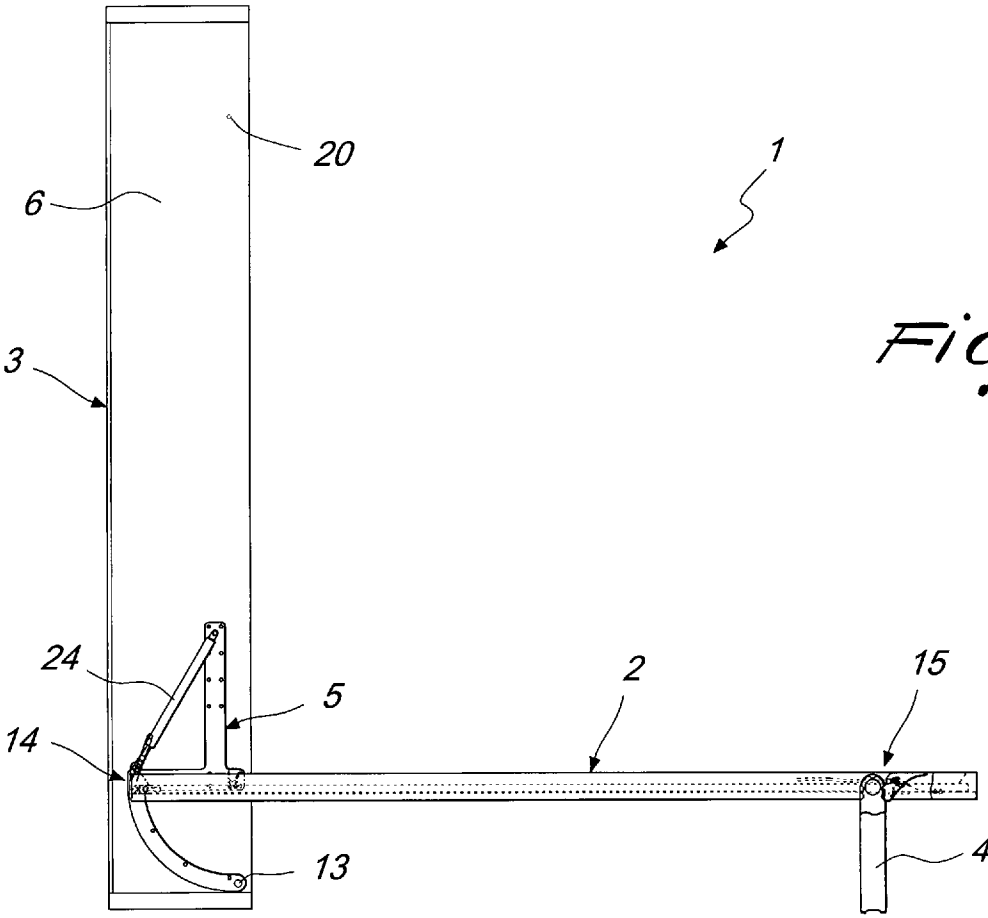
FIG. 3 is a side view of the pull down bed shown in the open position, for use as a bed.
Figure 4:
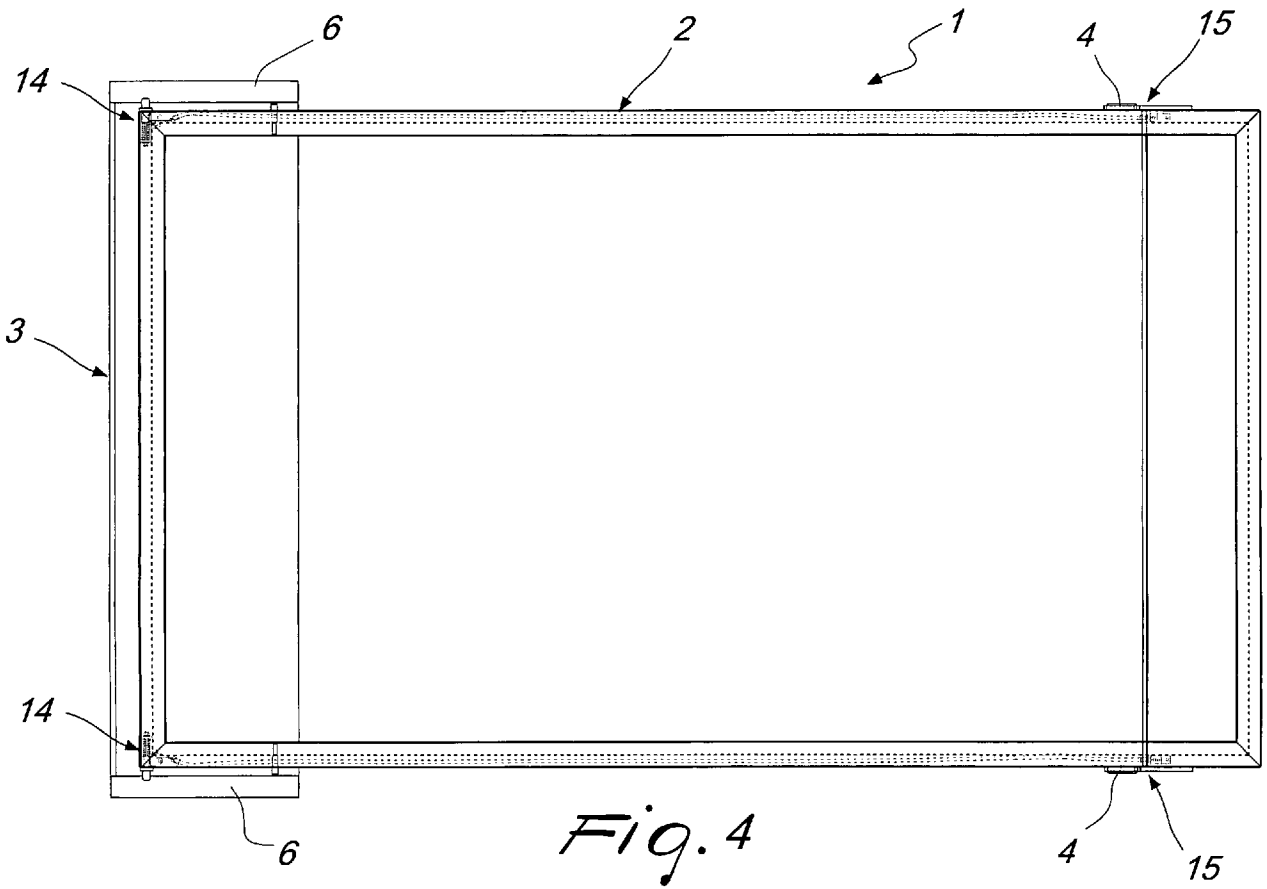
FIG. 4 is a plan view of the pull down bed shown in the open position, for use as a bed.

With reference to the cited figures, a pull down bed according to the invention, generally designated by the reference numeral 1, comprises a movable framework 2, which constitutes the mattress frame, and is hinged to a container body 3, which constitutes a piece of furniture, so as to define a closed position, visible in FIG. 1, in which the framework 2 is substantially inside the container body 3, and an open position, for use as a bed, which is visible in FIG. 3 and in which the framework is in the horizontal position and rests on the ground by means of feet 4.

The framework 2 is hinged to the piece of furniture 3 by means of a pair of mounting plates 5 applied to the inner sides of the shoulders 6 of the piece of furniture 3.

Each plate 5 can be inserted in a recess, which is formed in the respective shoulder 6, so that the plate is flush with the surface of the shoulder.

Each mounting plate 5 is constituted by an upright 7, a horizontal crossmember 8 and a curved portion 9.

The horizontal crossmember 8 has a seat 10 that accommodates a rotation pivot 11 which is jointly connected to the framework 2.

The rotation pivots 11 allow the rotation of the framework 2 about the axis that passes through the pivots.

The two pivots 11 engage in the seat 10 of the plates 5, which are recessed in the shoulders of the piece of furniture.

After engagement, a screw is inserted for safety and prevents the pivot 11 from exiting from its seat 10 during rotation. This operation is quick and with limited risk of error.

The plate 5 has two holes provided in the curved portion 9, an upper hole 12 and a lower hole 13, which allow to lock the frame 2 in its positions of maximum opening, when the bed is completely open in the horizontal position, and maximum closure, when the bed is completely closed in a vertical position.

The mattress frame is locked by means of a locking device, generally designated by the reference numeral 14, which is actuated by an actuation device 15.

The actuation device comprises the foot 4, which is arranged on each side of the mattress frame 2 and has three functions: a support of the mattress frame in a horizontal position, a lever for the actuation of the upper and lower hooks for fastening the mattress frame in the vertical position, and a handle for lowering the mattress frame.

Each foot 4 can include a height adjustment system, which is not visible in the figures.

The portion of the foot 4 that is hinged to the mattress frame 2 has three radial slots, designated respectively by the reference numerals 16, 17 and 18, which are adapted to lock the foot in the various positions for use.

The actuation device 15 comprises a hook 19, which is hinged to the mattress frame 2 and is adapted to engage the slots of the foot in order to lock it in the various positions. The foot 4 acts as a lever for the actuation of the hook 19.

The hook 19 is adapted to lock the mattress frame 2 in the closure position, by engaging a pin 20 provided on each shoulder 6 of the piece of furniture 3.

The hook 19 is designed to transmit the various movements to the locking device 14 through a transmission cable 21.

The locking device 14 prevents any movement of the mattress frame in the fully open and fully closed positions.

The locking device 14 comprises a pin with a rack 22, which in its inactive position is inserted in the lower hole 13 or upper hole 12 of the plate 5, depending on whether the mattress frame is in the closed or open position respectively.

The rack of the pin 22 is engaged by a gear 23, which is connected to the transmission cable 21, so that when one acts on the foot 4 the hook 19 is turned and, by rotating, pulls the transmission cable 21, which in turn moves the gear 23 of the pin 22. The gear 23 moves the locking pin 22, which by retracting in contrast with a contrast spring 25 exits from the hole 12 or 13 of the plate 5 and releases the mattress frame 2.

The mattress frame also comprises a gas spring 24, which has one end hinged to the upright 7 of the plate 5 and the other end hinged to the mattress frame 2 in a position that is proximate to the locking device 14.

Figure 2:
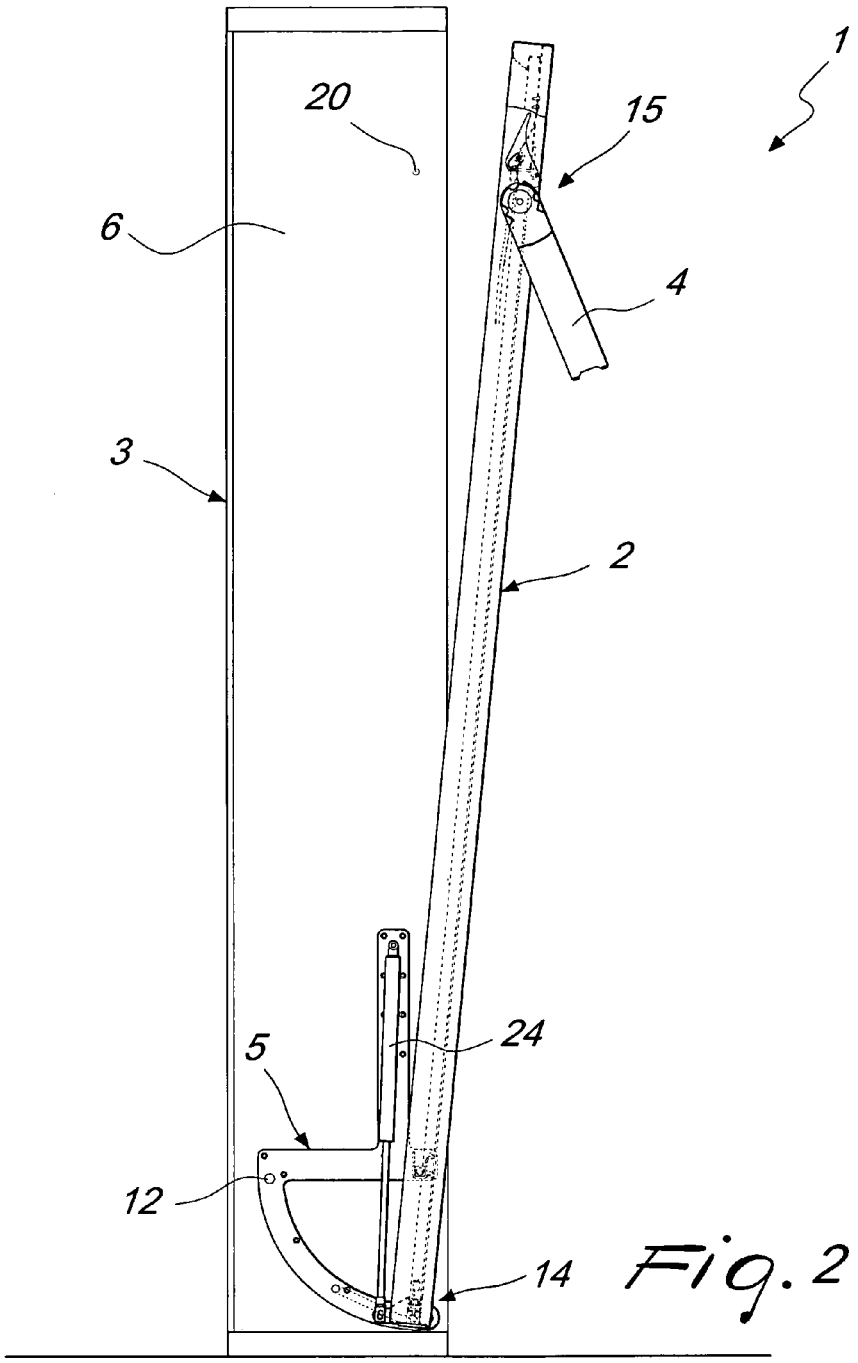
FIG. 2 is a view, similar to the preceding one, illustrating the mattress frame in an intermediate position in the opening step.
Figure 5:
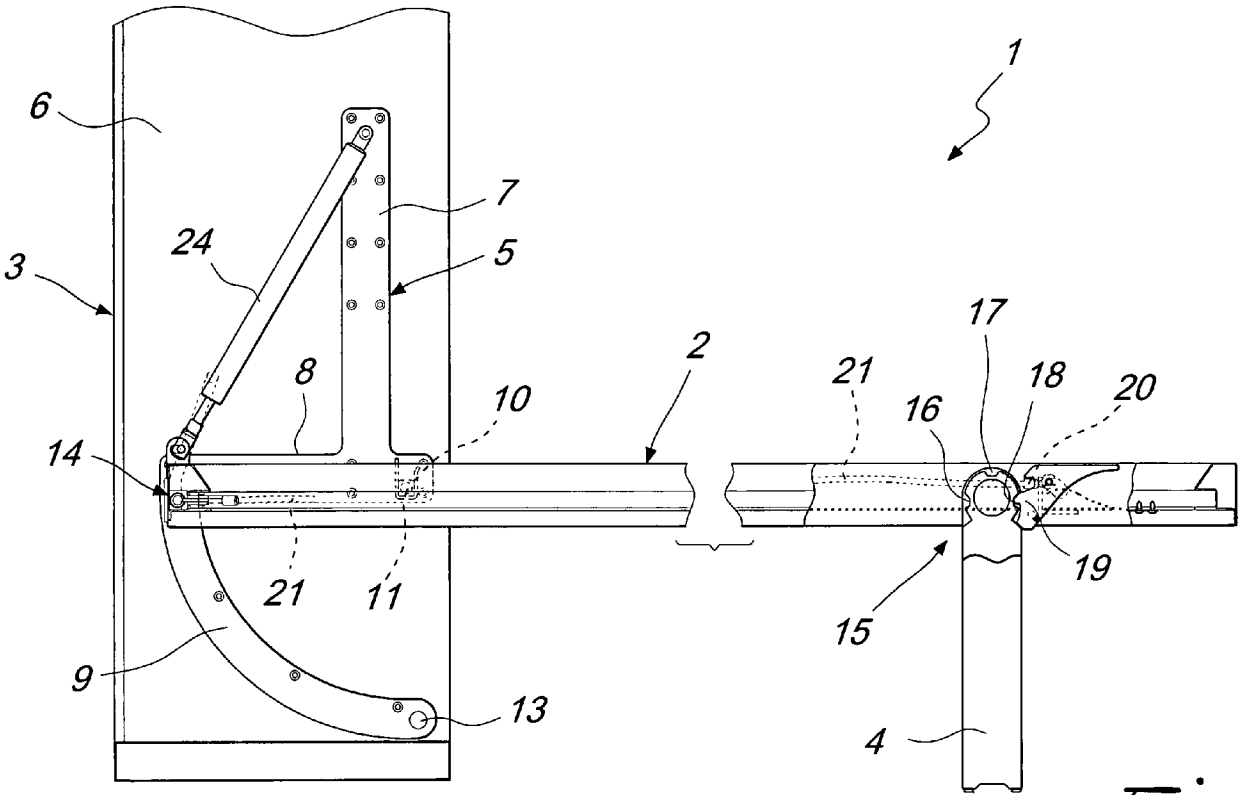
FIG. 5 is an enlarged side view of the pull down bed in the open position, for use as a bed.
Figure 6:
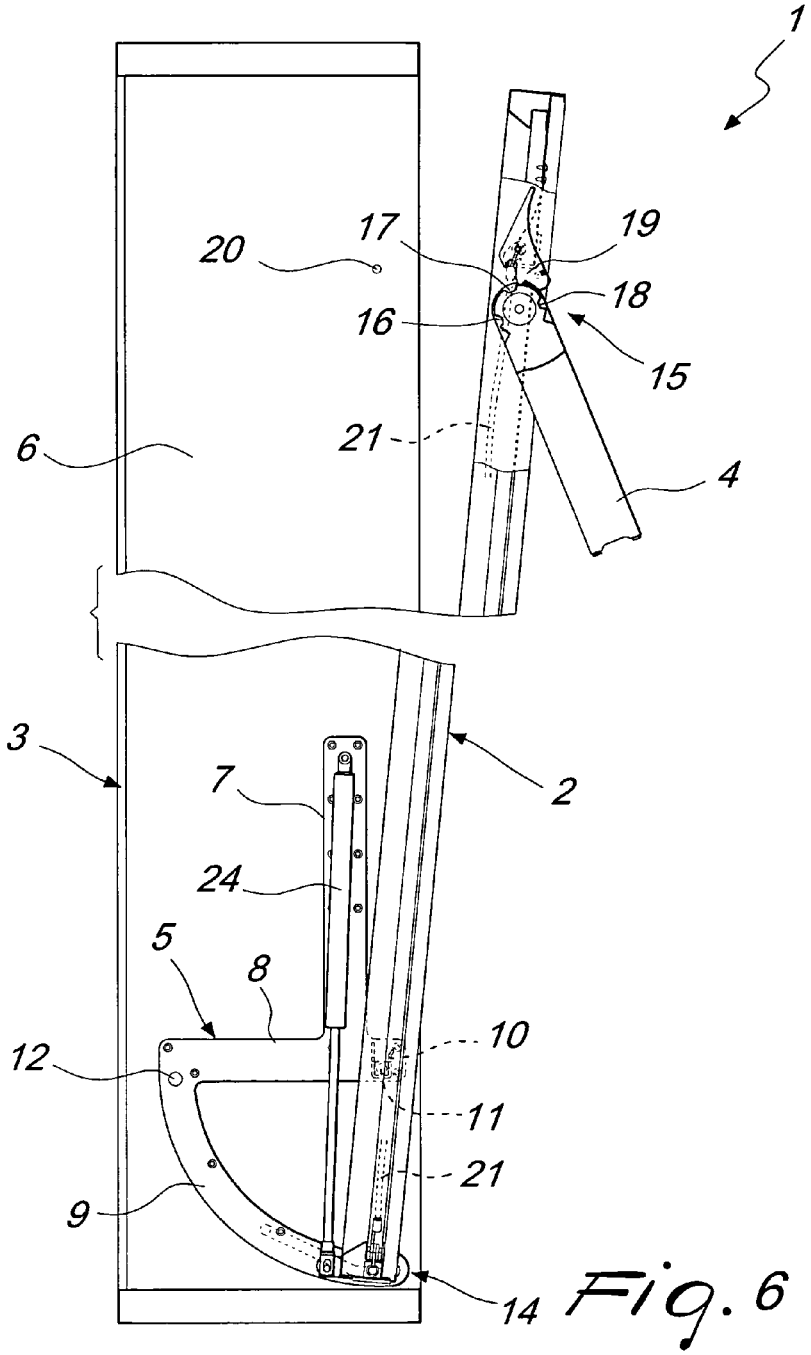
FIG. 6 is a view, similar to the preceding one, illustrating the structure in an intermediate position in the opening step.
Figure 7:
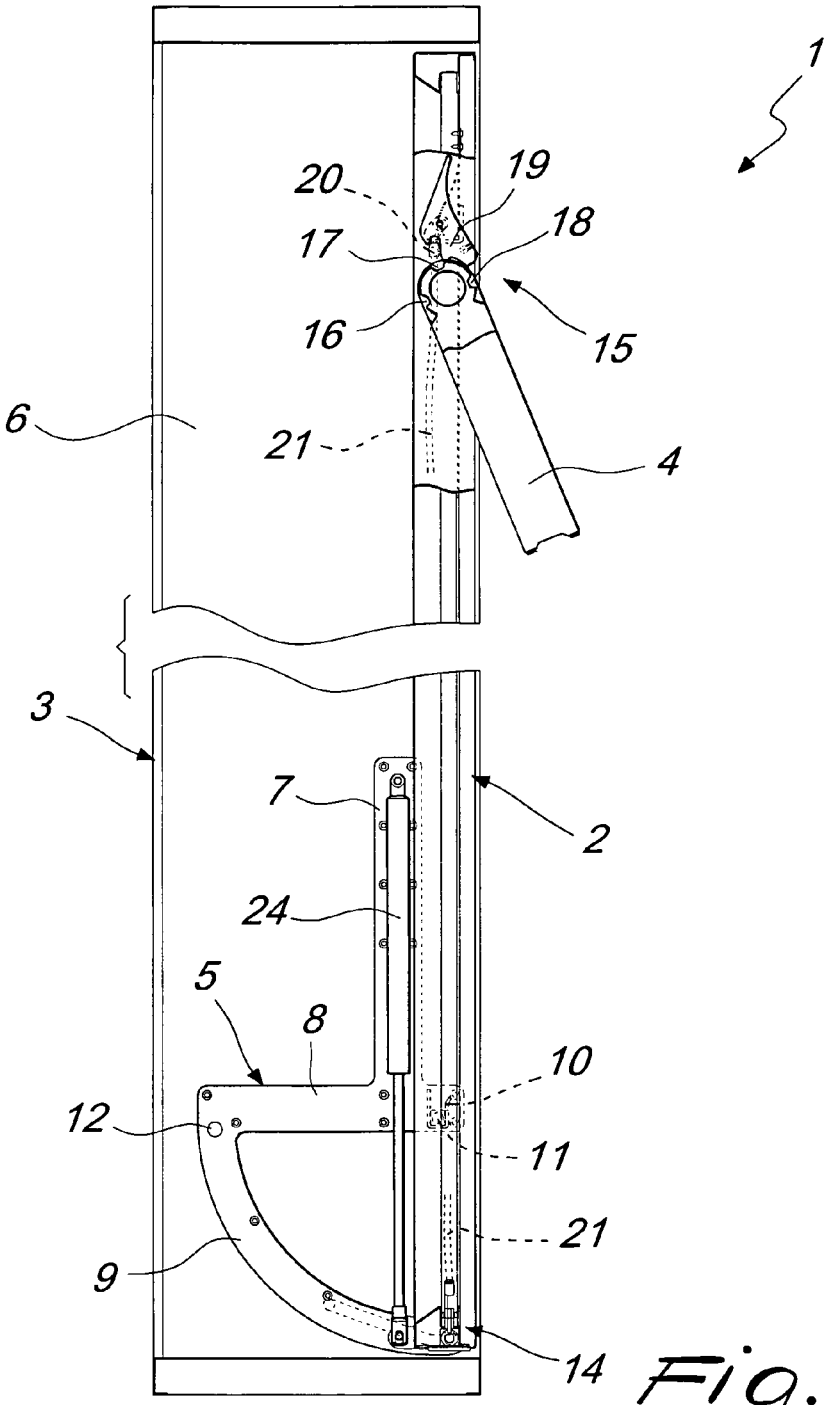
FIG. 7 is a side view, enlarged with respect to FIG. 1, illustrating the mattress frame in the closed position at the beginning of the opening action.
Figure 8:
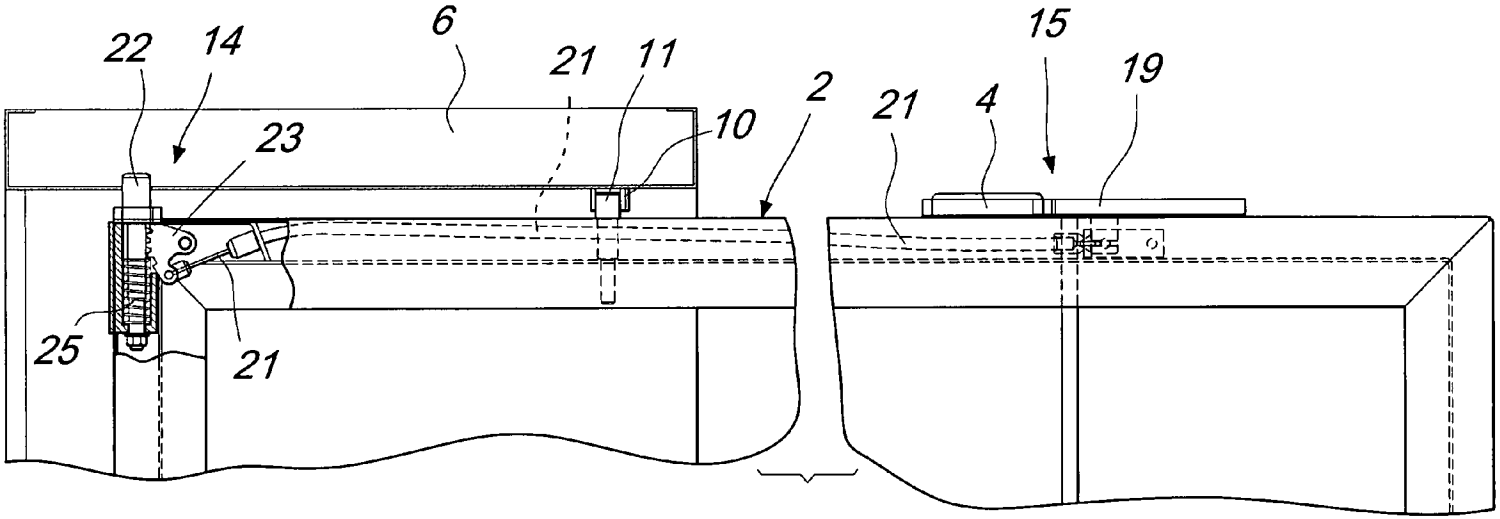
FIG. 8 is a plan view of the pull down bed shown in the open position, for use as a bed, with the locking device inserted.
Figure 9:
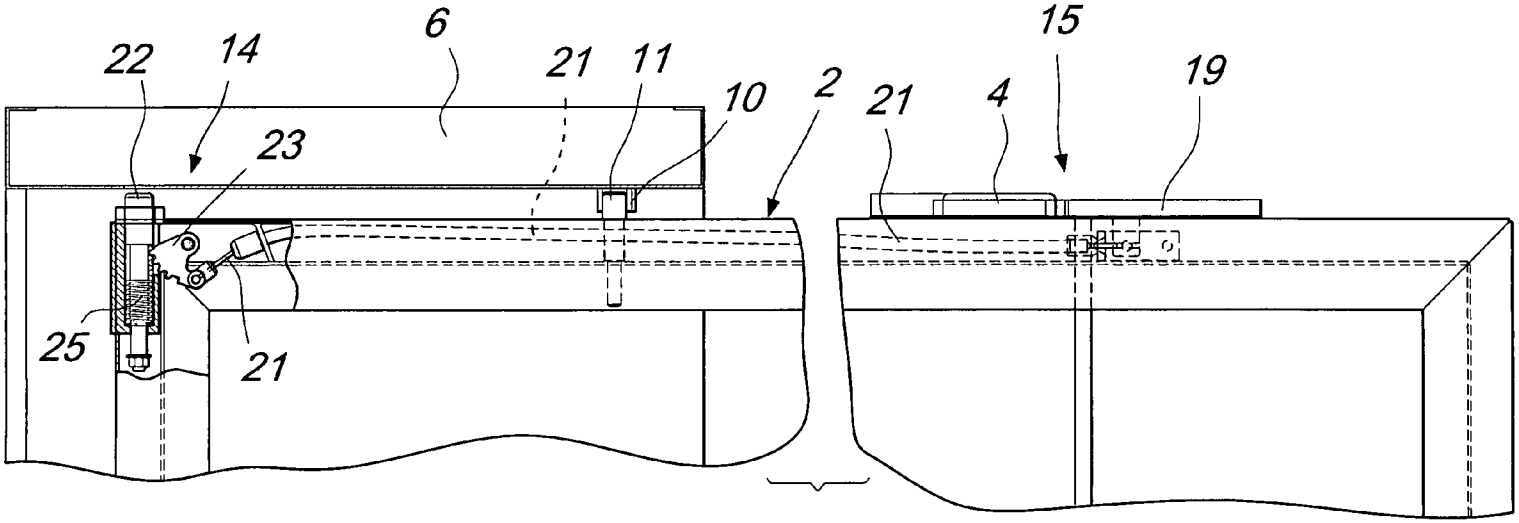
FIG. 9 is a view, similar to the preceding one, in which the device is shown in the release step.

FIG. 1-3 illustrate in sequence the steps of the opening of the mattress frame, while FIGS. 5-7 illustrate in sequence the steps for closing the mattress frame.

The opening sequence of the bed includes the following steps.

In the closed position, the foot 4 is in a vertical position, arranged between the lateral longitudinal member of the mattress frame 2 and the shoulder 6 of the piece of furniture 3, the hook 19 engages the slot 17 of the foot 4 and keeps it locked in position; the locking pin 22 is inserted in the lower locking hole 13 of the plate 5.

The foot 4 is manually extracted and its rotation causes the hook 19 to lift and disengage the locking pin 20 as can be seen in FIG. 1.

The rotation of the hook 19 pulls the transmission cable 21, which turns the gear 23, causing the retraction of the locking pin 22, which exits from the lower hole 13, allowing the free rotation of the mattress frame 2.

By gripping the foot 4 with one's hands and pulling toward oneself, overcoming the slight contrast force produced by the gas springs 24 that support the weight of the mattress frame and the mattress, as visible in FIG. 2, the mattress frame 2 is moved almost to its point of maximum opening.

At this point is sufficient to push the mattress frame downward in the fully horizontal position in order to allow the foot to lock.

Locking occurs by the hook 19 engaging the slot 18 of the foot 4 while at the same time the locking pin 22 enters the upper hole 12 of the plate 5.

The mattress frame 2 is in the maximum opening position, which is completely horizontal.

The closure operation of the bed includes the following steps.

One acts on the hook 19 with a slight pressure to release the foot 4 and by pulling the transmission cable 21, which actuates the gear 23 of the locking device 14, which causes the retraction of the locking pin 22, releasing the mattress frame.

At this point, the mattress frame is slightly lifted because of the action of the gas springs 24.

The user can place himself in front of the bed and, with one hand, can move the mattress frame 2 to its position of maximum closure (which is completely vertical), as shown schematically in FIGS. 6 and 7.

The foot 4 is automatically arranged vertically automatically by gravity and the hook 19 resets the foot 4, engaging the slot 17.

While the hook 19 engages the locking pin 20, the locking pin 22 enters the lower hole 13 of the plate 5.

In practice it has been found that the invention achieves the intended aim and objects, providing a pull down mattress frame with self-locking feet and pins.

A further advantage of the invention is that the pull down mattress frame 2 is constituted by a folded sheet metal and this allows to fasten a covering panel to the frame without the aid of screws or bolts.

The cross-section of the framework of the mattress frame has been designed as if it were an extruded element, but in practice it is obtained by folding a sheet metal.

The particular cross-section of the frame has a curl on which a covering panel is inserted which constitutes the face.

The mattress frame according to the present invention allows to use covering panels that have a reduced thickness, for example 10 mm, with the result of having a considerable external aesthetic cleanliness; indeed, approximately 3 mm of wood are visible flush to the profile.

Of course, the mattress frame allows to fit thicker covering panels, with the appropriate dimensional modifications of other components such as for example the gas springs.

On the inner side also, when the mattress is lifted, no elements for anchoring between the face and the frame can be seen and no screws or bolts are visible.

Since there are no fasteners, assembly is facilitated considerably and is faster, because the cross-section of the framework is suitable to accommodate slats and supports directly in the profile of the framework.

Each foot 4 is made of a flat metallic element, with a reduced lateral dimension, such that in the closed position it is included completely between the mattress frame and the shoulder of the piece of furniture.

The foot acts as a handle for the movement of the mattress frame.

The automatic locking pin 22 allows to position the mattress frame in full safety, both in the vertical closed position and in the horizontal open position.

The foot constitutes in practice the only actuation element for the entire movement of the mattress frame and of the locking devices.

To position the mattress frame it is in fact sufficient to extract the foot with one finger and pull it toward oneself in order to make the mattress frame descend.

By means of this simple gesture, all the release mechanisms of the mattress frame are actuated.

When the mattress frame is closed, the automatic foot is pivoted to the mattress frame and is locked by the hook 19.

By extracting the foot from the closed position, one acts both on the hook 23, which constitutes the upper block, and on the pin 22, which constitutes the lower block, releasing the mattress frame.

During its stroke, the foot always remains in the vertical position, by gravity, and reengages the hook 19 when the mattress frame is in the fully horizontal position.

In the horizontal position of the mattress frame, the foot is locked completely and supports the mattress frame.

The automatic locking of the mattress frame in the horizontal position is thus achieved.

Another advantageous characteristic of the present invention is constituted by the locking system, which is provided by the interaction of the pin 22 with the holes 12 and 13 of the plate 5.

This locking system is actuated simply by moving the foot 4.

Its function is extremely advantageous, because it allows fully safe positioning of the mattress frame both in the vertical position, because it prevents, together with the hook 19, its sudden opening, and in a horizontal position, because it prevents its lifting.

The present system in fact allows to use gas springs 24 that are slightly more powerful and allow the mattress frame to make its descent very soft and not to strike the floor, if it is let go, preventing dangerous situations.

Once the mattress frame has been released from the closure position, it descends until it reaches complete balancing of the gas springs, remaining raised from the ground. Then the mattress frame is pushed downward until it reaches its fully horizontal position.

The automatic locking system is indeed designed to stop the mattress frame in this position.

The plate 5 is directly fastened to the shoulder of the piece of furniture and is used to move and lock the slatted mattress frame of the bed.

This application claims the priority of Italian Patent Application No. MI2009A000656, filed on Apr. 21, 2009, the subject matter of which is incorporated herein by reference.

The invention claimed is:

1. A pull down bed, with automatic locking device, comprising a movable framework, which constitutes a mattress frame and is hinged to a container body, which constitutes a piece of furniture, so as to define a closed position, in which said mattress frame is substantially inside said piece of furniture, and an open position, for use as a bed, in which said mattress frame is in a horizontal position and rests on the ground by means of feet, wherein:

said mattress frame is hinged to said piece of furniture at one end and has said feet at the other end;

said mattress frame is hinged to said piece of furniture by means of a pair of mounting plates which are applied to sides of said piece of furniture;

the pull down bed further comprises a locking device for locking said mattress frame in said closed and horizontal position, said locking device is actuated by an actuation device, said actuation device comprises said feet;

at least one of said plates is provided with two holes, an upper hole and a lower hole, which allow the locking of said mattress frame in said horizontal and closed position;

said locking device comprises a pin with a rack which is associated with said mattress frame, said pin with rack being inserted, in an inactive position, in one of said holes, the lower one or the upper one, depending on whether the mattress frame is respectively in the closed or open position;

said pin is actuatable by said actuation device in order to clear said holes and allow the passage of said mattress frame from one position to the other, the rack of said pin with rack being engaged by a gear, which is connected to said actuation device by means of a transmission cable, said actuation device comprising at least one of said feet, such foot acting as an actuation lever for a hook and as a handle for folding said mattress frame;

a portion of said foot pivoted to said mattress frame has three radial slots for locking said foot in the various positions for use;

said hook is hinged to said mattress frame and is adapted to engage said slots of said foot in order to lock it in the various positions;

said hook transmits the movement to said locking device through said transmission cable;

when one acts on said foot, said hook is turned, said hook rotates and pulls said transmission cable, said transmission cable moves said gear of said pivot with rack, and said gear moves said pivot with rack which, by retracting in contrast with a contrast spring, exits from said hole of said plate and releases the mattress frame.

2. The pull down bed according to claim 1, wherein said mounting plates are applied to the internal sides of shoulders of said piece of furniture; each of said mounting plates is inserted in a contoured recess, which is provided in a respective shoulder and is flush with a surface of the respective shoulder.

3. The pull down bed according to claim 2, wherein each said mounting plate is constituted by an upright, a horizontal crossmember and a curved portion; said horizontal crossmember has a seat that accommodates a rotation pivot which is jointly connected to said mattress frame.

4. The pull down bed according to claim 1, wherein each foot comprises a height adjustment system.

5. The pull down bed according to claim 1, wherein said hook is designed to lock in the closure position said mattress frame by engaging a pin that is present on each shoulder of said piece of furniture.

6. The pull down bed according to claim 2, further comprising a gas spring, which has one end hinged to said plate and the other end hinged to said mattress frame in a position that is proximate to the locking device; said gas spring supports the weight of said mattress frame and of the mattress that is associated therewith.

7. The pull down bed according to claim 1, wherein said mattress frame is formed from a folded sheet metal.

8. A pull down bed, with automatic locking device, comprising a movable framework, which constitutes a mattress frame and is hinged to a container body, which constitutes a piece of furniture, so as to define a closed position, in which said mattress frame is substantially inside said piece of furniture, and an open position, for use as a bed, in which said mattress frame is in a horizontal position and rests on the ground by means of feet, wherein:

said mattress frame is hinged to said piece of furniture at one end and has said feet at the other end;

said mattress frame is hinged to said piece of furniture by means of a pair of mounting plates which are applied to sides of said piece of furniture;

the pull down bed further comprises a locking device for locking said mattress frame in said closed and horizontal position, said locking device is actuated by an actuation device, said actuation device comprises said feet;

at least one of said plates is provided with two holes, an upper hole and a lower hole, which allow the locking of said mattress frame in said horizontal and closed position;

said locking device comprises a pin with a rack which is associated with said mattress frame, said pin with rack being inserted, in an inactive position, in one of said holes, the lower one or the upper one, depending on whether the mattress frame is respectively in the closed or open position; and said pin is actuatable by said actuation device in order to clear said holes and allow the passage of said mattress frame from one position to the other.

9. The pull down bed according to claim 8, wherein rack of said pin with rack is engaged by a gear, which is connected to said actuation device by means of a transmission cable.

10. The pull down bed according to claim 8, wherein each foot comprises a height adjustment system.

11. The pull down bed according to claim 8, further comprising a gas spring, which has one end hinged to said plate and the other end hinged to said mattress frame in a position that is proximate to the locking device; said gas spring supports the weight of said mattress frame and of the mattress that is associated therewith.

12. The pull down bed according to claim 8, wherein said mattress frame is formed from a folded sheet metal.

* * * * *